US009040855B2

(12) United States Patent
Werner et al.

(10) Patent No.: US 9,040,855 B2
(45) Date of Patent: May 26, 2015

(54) 3-DIMENSIONAL SEAL FOR A BUTTON

(75) Inventors: Christopher M. Werner, San Jose, CA (US); Stephen Brian Lynch, Portola Valley, CA (US)

(73) Assignee: APPLE INC., Cupertino, CA (US)

( * ) Notice: Subject to any disclaimer, the term of this patent is extended or adjusted under 35 U.S.C. 154(b) by 291 days.

(21) Appl. No.: 13/610,724

(22) Filed: Sep. 11, 2012

(65) Prior Publication Data

US 2014/0069786 A1 Mar. 13, 2014

(51) Int. Cl.
*H01H 13/06* (2006.01)

(52) U.S. Cl.
CPC ..... *H01H 13/06* (2013.01); *H01H 13/063* (2013.01)

(58) Field of Classification Search
CPC ..... H01H 13/06; H01H 13/14
USPC ..... 200/302.2, 302.1, 300, 314, 341
See application file for complete search history.

(56) References Cited

U.S. PATENT DOCUMENTS

| | | | | |
|---|---|---|---|---|
| 5,258,592 | A * | 11/1993 | Nishikawa et al. | 200/302.2 |
| 6,626,473 | B1 * | 9/2003 | Klein et al. | 200/302.2 |
| 8,227,720 | B2 * | 7/2012 | Tsuchiya et al. | 218/136 |
| 8,410,383 | B2 * | 4/2013 | Clark et al. | 200/330 |
| 8,637,781 | B2 * | 1/2014 | Derengowski et al. | 200/302.2 |
| 2006/0225995 | A1 | 10/2006 | Ohnishi | |
| 2007/0034493 | A1 | 2/2007 | Kawasaki et al. | |
| 2010/0000973 | A1 * | 1/2010 | Tsuchiya et al. | 218/140 |
| 2011/0048909 | A1 * | 3/2011 | Clark et al. | 200/330 |
| 2013/0105288 | A1 * | 5/2013 | Derengowski et al. | 200/302.2 |

FOREIGN PATENT DOCUMENTS

| | | |
|---|---|---|
| KR | 200429738 | 10/2006 |
| KR | 1020120041609 | 5/2012 |
| WO | WO2012053743 | 4/2012 |

OTHER PUBLICATIONS

PCT Application No. PCT/US2013/056521—International Search Report & Written Opinion dated Dec. 19, 2013.

* cited by examiner

*Primary Examiner* — Amy Cohen Johnson
*Assistant Examiner* — Marina Fishman
(74) *Attorney, Agent, or Firm* — Downey Brand LLP

(57) ABSTRACT

Button assemblies including water tight seals and methods for making the same are provided. The button assembly can include a button made from a rigid material having a cosmetic portion and a post. The post may extend from a bottom surface of the button and activate a switch of the electronic device when the button is actuated. Additionally, the button assembly can include a sealing member made from a compliant material having a post receiving hole. The sealing member may be secured to the button and an interior surface of a housing of the electronic device. The post receiving hole may fit around and engage the post. In some embodiments, the button may include a cavity and the sealing member may include a protruding member. In these embodiments, the cavity can receive the protruding member to provide for better registration of the sealing member to the button during assembly.

23 Claims, 10 Drawing Sheets

3-DIMENSIONAL SEAL FOR A BUTTON

BACKGROUND

This disclosure is related to button assemblies for electronic devices, and more particularly to a water tight seal for a button in an electronic device and methods for making the same.

One common way for users to provide inputs to electronic devices (e.g., portable media players and cellular telephones) is through the use of a button. A switch (e.g., a dome switch or other push-button style switch) is typically mounted behind the button, and the button activates the switch when a user actuates the button. When activated, the switch completes a circuit and can provide electrical signals to other components of the electronic device.

In some applications it is advantageous for a button assembly to have a water tight seal for preventing liquids from entering an electronic device and contacting internal components of the device. For example, if a user mistakenly pours liquid on the electronic device, the liquid can sometimes come into contact with internal circuit elements of the device. Water or any other foreign liquid coming into contact with one or more of the circuit elements may short a circuit of the device or otherwise damage a component of the device.

Conventional water tight seals for buttons include the use of o-rings or compressible membranes/gaskets. The water tight members are often secured to the buttons using adhesives (e.g., a pressure sensitive adhesive). These implementations result in unsatisfactory button feel and response. Moreover, the use of a pressure sensitive adhesive (PSA) to secure water tight members to buttons is not reliable when the PSA is applied to curved surfaces.

Accordingly, there is a need for improved button assemblies.

SUMMARY

Button assemblies including water tight seals and methods for making the same are provided. The button assembly can include a button made from a rigid material having a cosmetic portion and a post. The cosmetic portion may be exposed to a user for actuation and may form an exterior surface of an electronic device. The post may extend from a bottom surface of the button and can activate a switch of the electronic device when the button is actuated. Additionally, the button assembly can include a sealing member made from a compliant material having a post receiving hole. The sealing member may be secured to the button and an interior surface of a housing of the electronic device. The post receiving hole can fit around and engage the post. The sealing member can engage an outer periphery of the button and may be secured to the button by glue and/or PSA. In addition, the post receiving hole can form an interference fit with the post.

In some embodiments, the button may include a cavity and the sealing member may include a protruding member. In these embodiments, the cavity can receive the protruding member to provide for better registration of the sealing member to the button during assembly. In some embodiments, the protruding member may be constructed from the same compliant material as the remainder of the sealing member. In other embodiments, the protruding member may include a rigid material. For example, in some embodiments, the protruding member can include a co-molded part that provides enhanced stiffness with respect to the remainder of the sealing member. Regardless of the composition of the protruding member, the protruding member may include registration holes that help locate the sealing member relative to another component of the electronic device.

According to an embodiment, an electronic device can include a housing, a button, and a seal assembly. The housing can include a sidewall having a first surface and an aperture. The button can include a cosmetic portion, a cavity, and a post. The cosmetic portion extends through the aperture. The seal assembly is secured to the button and the first surface. The seal assembly includes a protruding member and a post receiving hole. The protruding member occupies the cavity and is fixed to a portion of an interior surface of the button. The post extends through and is secured to the post receiving hole.

According to another embodiment, there is provided a method for assembling a water proof button in an electronic device. The device can include a housing that includes a sidewall having a first surface and an aperture. The method may include inserting a button into the aperture. The button can include a cavity and a post. The method also may include applying glue to the first surface. The method may further include securing a sealing assembly to the button and the first surface. The sealing assembly can include a protruding member, adhesive, and a post receiving hole. The protruding member is secured to the cavity by the adhesive, the post is secured to the sealing assembly via the post receiving hole, and the sealing assembly is fixed to the first surface via the glue.

According to yet another embodiment, there is provided a water tight button assembly for use in an electronic device. The electronic device can have a housing that includes a sidewall and an aperture. The button assembly can include a button and a seal assembly. The button can include a cosmetic portion, a cavity and a post. The cosmetic portion extends through the aperture. The seal assembly can be secured to the button and an inner surface of the sidewall. The seal assembly can include a protruding member and a post receiving hole. The protruding member occupies the cavity and is fixed to a portion of an interior surface of the button. The post extends through and is secured to the post receiving hole.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Button assemblies including water tight seals and methods for making the same are described below with reference to FIGS. 1-8.

Figure 1:
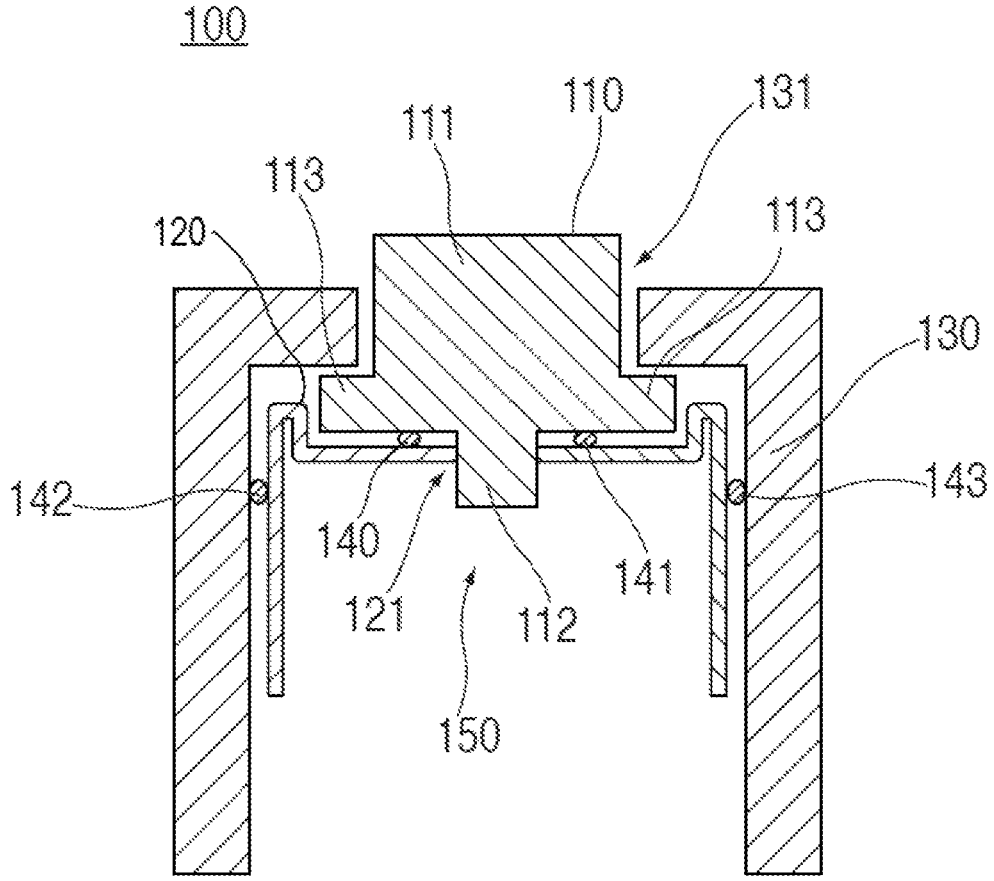
FIG. 1 shows a cross-sectional view of an illustrative electronic device including a button assembly in accordance with an embodiment of the invention.

FIG. 1 shows a cross-sectional view of electronic device 100 in accordance with an embodiment of the invention. Electronic device 100 may be a portable media device (e.g., an iPod™ or iPhone™ available from Apple, Inc. of Cupertino, Calif.) or a personal media device accessory (e.g., an audio controller for a media device). Electronic device 100 may include button 110, sealing member 120, and housing 130. A user can press button 110 to change an attribute of the electronic device (e.g., the volume level of the device) or a functional state of the device (e.g., whether the device should power up or turn off).

Button 110 may include cosmetic portion 111, post 112, and flange portions 113. Cosmetic portion 111 may extend through an opening 131 of an outer housing 130 of electronic device 100 such that cosmetic portion 111 may be accessible to a user of the device. The user may apply a force to cosmetic portion 111 in order to actuate button 110. Post 112 may extend from a bottom surface of button 110, and may be aligned with a switch (not shown) located in cavity 150 of electronic device 100. When button 110 is actuated, post 112 may contact and activate the switch. Although shown centered, it is understood that post 112 may be offset and not centered in the middle of button 110. Flange portions 113 may extend from sidewalls of button 110. Flange portions 113 can engage portions of housing 130 and keep button 110 from passing through opening 131 of housing 130. In this manner, flange portions 113 can secure button 110 to housing 130.

Button 110 can be made from any suitable material such as metal or plastic, and can have any suitable shape. For example, the shape of cosmetic portion 111 may be selected based on aesthetic considerations. Additionally, while post 112 is depicted as having a rectangular shape, it is understood that post 112 can have any suitable shape (e.g., cylindrical). Button 110 can be formed using any suitable process. For example, processes can include, but are not limited to, machining button 110 using a computer numerical control (CNC) machine tool, laser cutting button 110, and injection molding button 110. Once button 110 has been formed, the surface of button 110 may be finished in any suitable way. For example, the surface of button 110 can be polished or roughed up. In some embodiments, a coating may be applied to button 110.

Sealing member 120 may include post receiving hole 121. Post receiving hole 121 may fit around post 112 and help ensure that sealing member 120 remains fixed to button 110. Post receiving hole 121 may have a shape that is substantially the same as a cross section of post 112. The dimensions of post receiving hole 121 may be slightly smaller than the dimensions of the cross section of post 112 such that post receiving hole 121 forms an interference fit with post 112. Sealing member 120 may be constructed from any suitable compliant material. For example, sealing member 120 may be constructed from silicone.

In addition to engaging post 112, sealing member 120 may be constructed to engage an outer periphery of button 110. For example, sealing member 120 may engage a bottom surface of button 111 as shown in FIG. 1. Glue and/or adhesive may secure sealing member 120 to button 110 (e.g., via glue 140 and 141). In some embodiments, sealing member 120 may also engage sidewalls of flange portions 113. In these embodiments, additional glue and/or adhesive may be used along the sidewalls. Although glue 140 and 141 are shown as being confined to a localized area between button 110 and sealing member 120, it is understood that glue 140 and 141 may be spread over the entirety of the interface between button 110 and sealing member 120.

Sealing member 120 may have any suitable shape. For example, sealing member 120 may be shaped to follow internal contours of electronic device 100 formed by its components (e.g., contours formed by button 110 and housing 130). To complete a water tight seal, sealing member 120 may be secured to an inner surface of housing 130 using glue and/or adhesive (e.g., via glue 142 and 143). Although glue 142 and 144 are shown as being confined to a localized area between sealing member 120 and housing 130, it is understood that glue 142 and 143 may be spread over the entirety of the interface between sealing member 120 and housing 130.

In some embodiments, electronic device 100 may include a bracket (not shown) located within cavity 150. The bracket may hold a switch component (not shown) of electronic device 100 in place and prevent the switch component from moving when a user presses on button 110. The bracket can be secured to housing 130 in any suitable manner. For example, the bracket may be fixed to housing 130 using one or more screws.

Figure 2A:
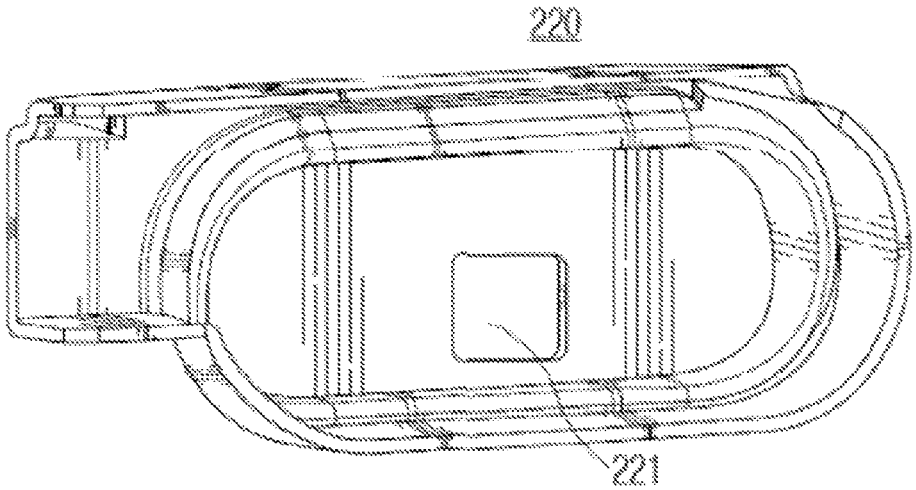
FIG. 2A shows a rear perspective view of an illustrative sealing member in accordance with an embodiment of the invention.
Figure 2B:
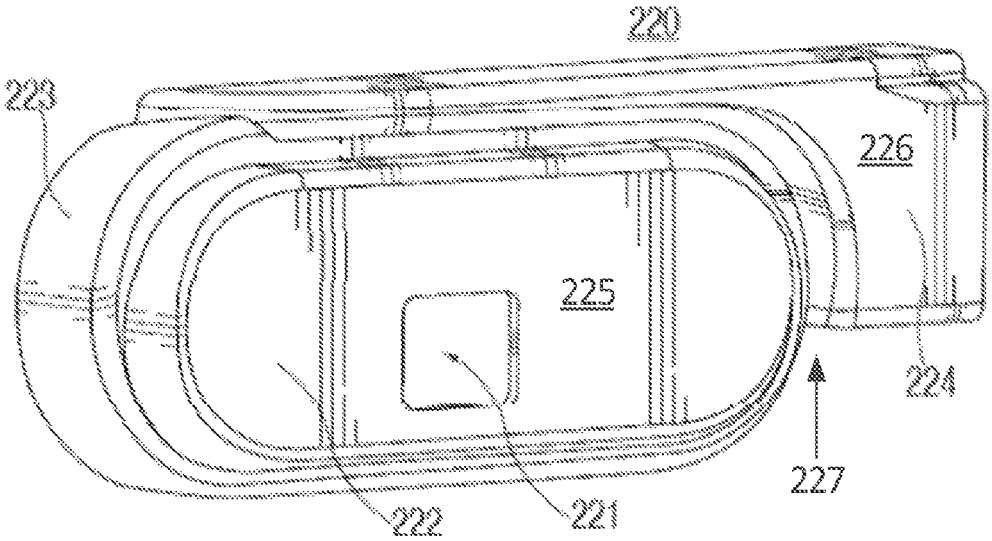
FIG. 2B shows a front perspective view of the sealing member of FIG. 2A in accordance with an embodiment of the invention.

FIGS. 2A and 2B show perspective views of an illustrative sealing member. In particular, FIG. 2A shows a rear perspective view of sealing member 220 and FIG. 2B shows a front perspective view of sealing member 220. Sealing member 220 may be included as part of a water tight button assembly in accordance with some embodiments of this invention. Sealing member 220 may be substantially similar to sealing member 120 of FIG. 1. As a result, sealing member 220 may share any features described with respect to sealing member 120, and vice versa.

As shown in FIGS. 2A and 2B, sealing member 220 may include post receiving hole 220. Post receiving hole 220 may be shaped to fit around a post of a button of an electronic device (e.g., post 112 of FIG. 1). Post receiving hole 221 may have dimensions that are slightly smaller than the post such that sealing member 220 forms a compression seal around the post. Although post receiving hole 221 is shown to have a substantially square shape, it is understood that post receiving hole 221 may have any suitable shape needed to accommodate a cross section of the post.

Sealing member 220 may also include button engagement portion 222. Button engagement portion 222 may include a top surface that couples to a bottom surface of a button (e.g., a bottom surface of button 110). The top surface may have the same shape and size as the bottom surface of the button. To facilitate coupling between sealing member 220 and the button, a glue or adhesive may be applied to the top surface.

Sealing member 220 may further include electronic device engagement portions 223 and 224. Device engagement portion 223 can be referred to as a first section and device engagement portion 224 can be referred to as a second section of the sealing member 220. Device engagement portions 223 and 224 may be fixed to interior surfaces of an electronic device. For example, referring briefly to FIG. 3B, device engagement portions 223 and 224 may be shaped to follow interior contours of a device housing (e.g., housing 330). Device engagement portion 223 can have first surface 225 and device engagement portion 224 can have second surface 226, where gap 227 separates first surface 225 and second surface 226. In order to fix sealing member 220 to the interior surfaces, a glue or adhesive may be applied to device engagement portions 223 and 224. In some embodiments, the glue or adhesive may instead be applied to the interior surfaces prior to installing sealing member 220.

Figure 3A:
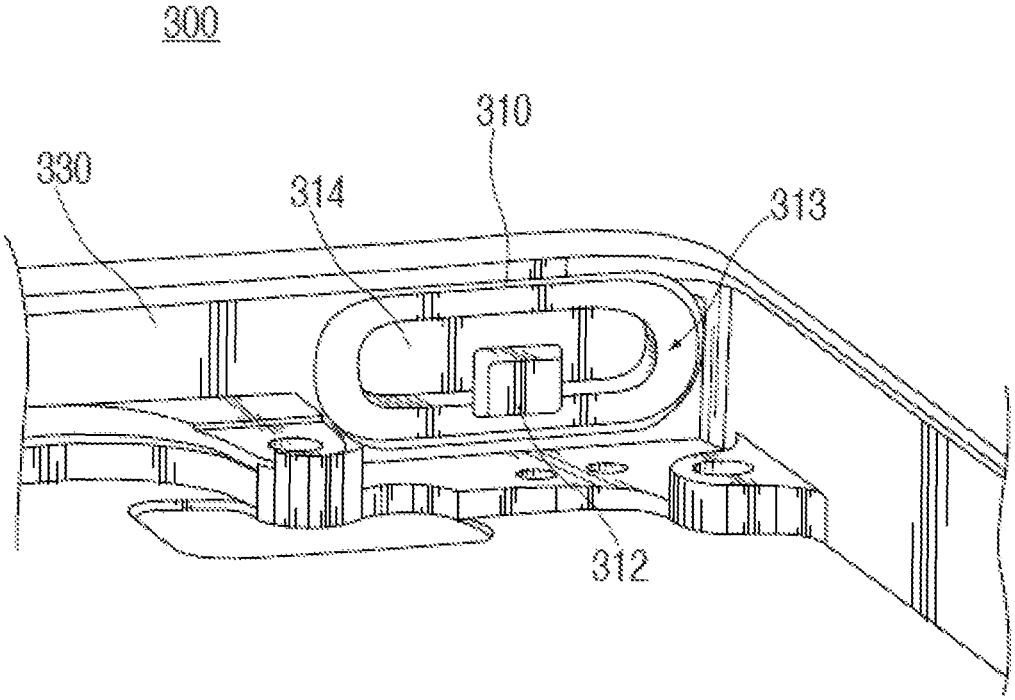
FIG. 3A shows a perspective view from the interior of an illustrative electronic device including a button in accordance with an embodiment of the invention.
Figure 3B:
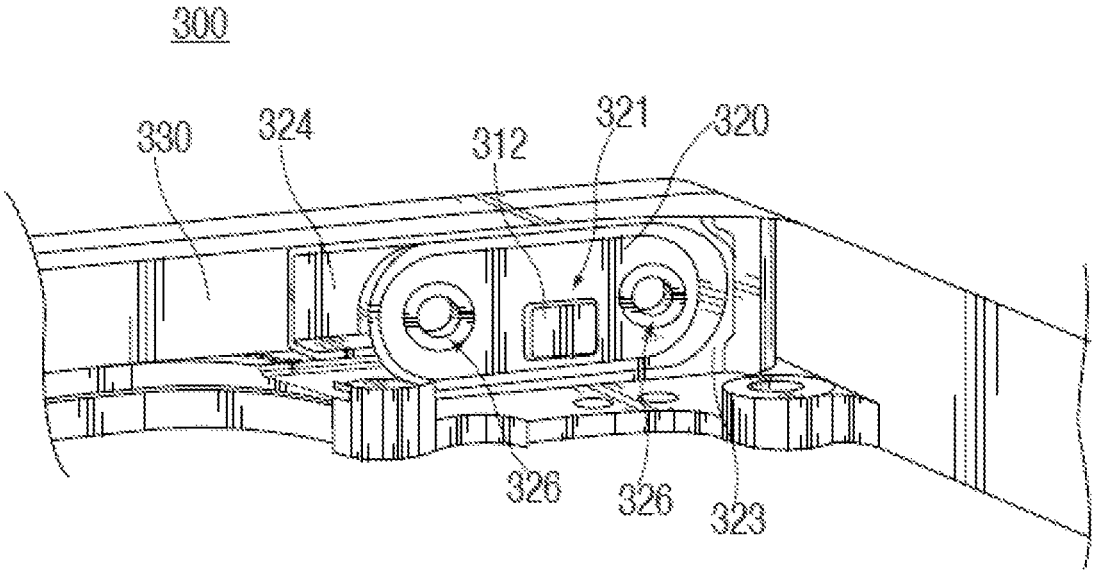
FIG. 3B shows a perspective view from the interior of the electronic device of FIG. 3A including a seal assembly in accordance with an embodiment of the invention.
Figure 3C:
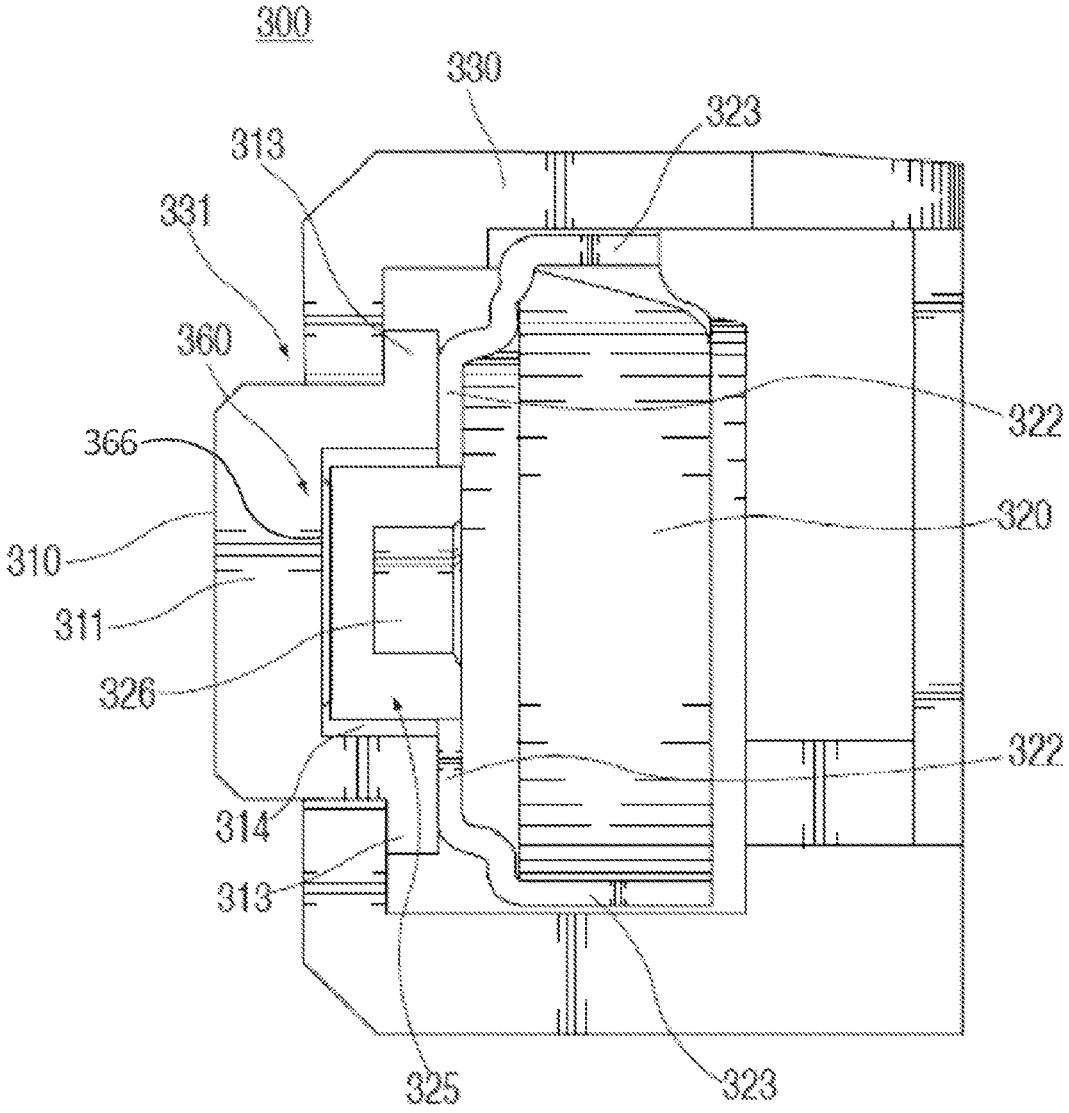
FIG. 3C shows a cross-sectional view of the electronic device of FIG. 3B in accordance with an embodiment of the invention.

Referring now to FIGS. 3A-3C, various views of an illustrative electronic device in accordance with an embodiment of the invention are shown. In particular, FIG. 3A shows a perspective view from the interior of electronic device 300 with button 310 installed. FIG. 3B shows a perspective view from the interior of electronic device 300 with button 310 and seal assembly 320 installed. FIG. 3C shows a cross-sectional view of electronic device 300 with button 310 and seal assembly 320 installed. Electronic device 300 may be similar to electronic device 100 of FIG. 1. As a result, similarly numbered elements of electronic device 300 may share any features described with respect to electronic device 100, and vice versa.

Electronic device 300 may include button 310 positioned within aperture 331 of housing 330. Button 310 may include cosmetic portion 311, post 312, flange portions 313, and cavity 314. Cosmetic portion 311 may form an exterior surface of electronic device 300 and can be accessible to a user of device 300. The user can press on cosmetic portion 311 to actuate button 310. Post 312 may extend from a bottom surface of button 310, and may be aligned with a switch (not shown) of electronic device 300. When button 310 is actuated, post 312 may contact and activate the switch. Flange portions 313 may extend from sidewalls of button 310. Flange portions 313 can engage portions of housing 330 and keep button 310 from passing through aperture 331 of housing 330. Cavity 314 may receive a portion of a sealing member in order to provide better registration of the sealing member to button 310 during assembly.

Electronic device 310 may also include seal assembly 320. Seal assembly 320 may be fixed to button 310 and housing 330 such that it forms a water tight seal with both button 310 and housing 330. In this regard, seal assembly 320 can prevent any foreign liquids or materials from entering electronic device 300 and damaging internal components of device 300. Seal assembly 320 may be formed from any material with suitable waterproof properties and flexibility to allow button 310 to be actuated without substantially interfering with the feel and/or response of button 310. For example, seal assembly 320 may be formed from silicone.

Seal assembly 320 may include post receiving hole 321, button engagement portion 322, device engagement portions 323 and 324. Post receiving hole 321 may fit around post 312 and help ensure that seal assembly 320 remains fixed to button 310. The dimensions of post receiving hole 321 may be slightly smaller than the dimensions of post 312 such that post receiving hole 321 forms an interference fit with post 312. Button engagement portion 322 may be coupled to a bottom surface of button 310. To facilitate coupling between button engagement portion 322 and button 310, a glue or adhesive may be applied between engagement portion 322 and button 310. Device engagement portions 323 and 324 may be fixed to interior surfaces of housing 330. In order to fix seal assembly 320 to the interior surfaces, a glue or adhesive may be applied to device engagement portions 323 and 324. In some embodiments, the glue or adhesive may instead be applied to the interior surfaces of housing 330 prior to installing seal assembly 320.

In some embodiments, seal assembly 320 may include protruding member 325. Cavity 314 may receive protruding member 325 and protruding member 325 may be shaped to occupy cavity 314. In this manner, cavity 314 and protruding member 325 provide for better registration of seal assembly 320 to button 310 during assembly. Protruding member 325 may be fixed to cavity 314 using adhesive 360. In some embodiments, protruding member 325 may be molded from the same material as the remainder of seal assembly 320. In other embodiments, protruding member 325 may include a co-molded part. In embodiments that include a co-molded part, the co-molded part can provide enhanced stiffness with respect to the remainder of seal assembly 320. Regardless of the composition of protruding member 325, protruding member 325 may include registration holes 326. Registration holes 326 may align with another component of electronic device 300 and may locate seal assembly 320 relative to the other component. In some embodiments, a first surface of sealing assembly 320 (similar to first surface 225 sealing member 220) is secured to internal surface 366 of button 310 and a second surface of sealing assembly 320 (similar to second surface 226 of sealing member 220) is secured to flange portion 313. In this way, button 310 can constrain the seal assembly 320 within the space of the housing 330.

Figure 4A:
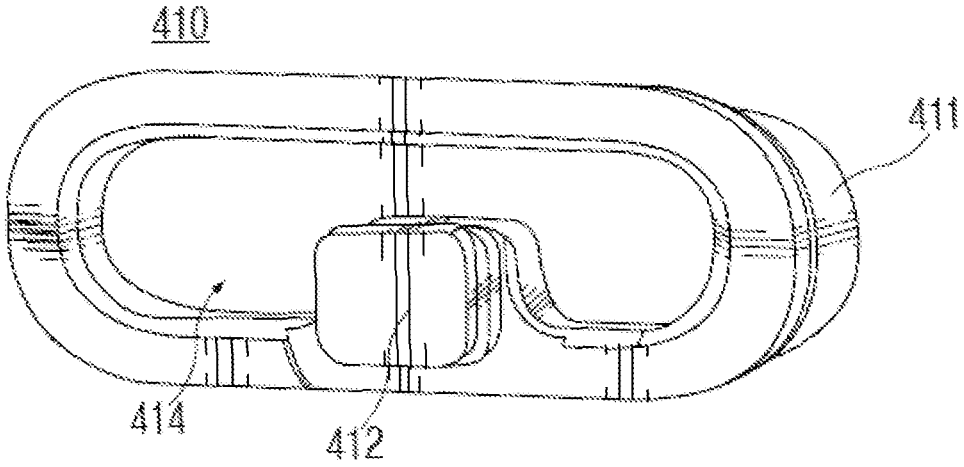
FIG. 4A shows a rear perspective view of an illustrative button in accordance with an embodiment of the invention.
Figure 4B:
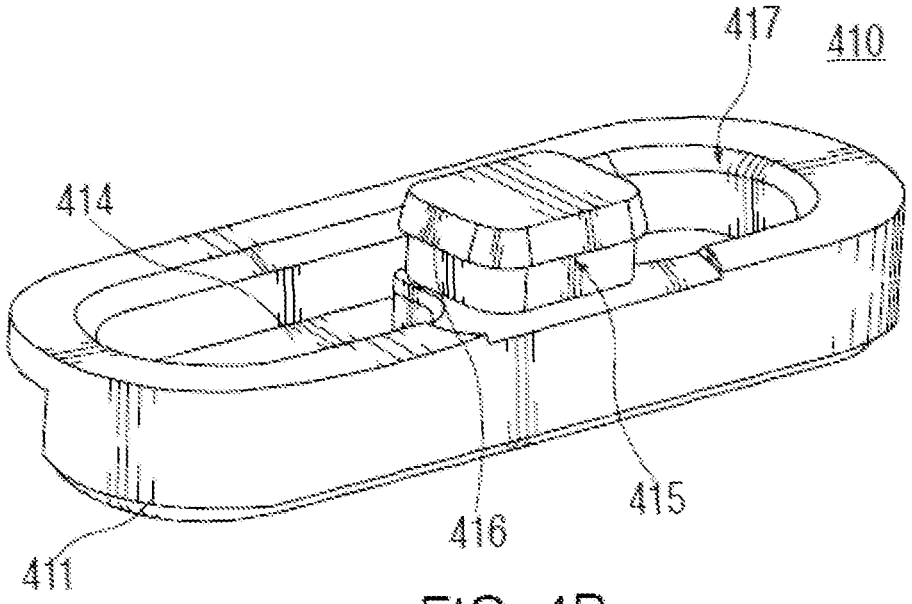
FIG. 4B shows a side perspective view of the button of FIG. 4A in accordance with an embodiment of the invention.

Turning now to FIGS. 4A and 4B, perspective views of an illustrative button are shown in accordance with some embodiments of this invention. In particular, FIG. 4A shows a rear perspective view of button 410 and FIG. 4B shows a side perspective view of button 410. Button 410 may be similar to buttons 110 and 310 shown in FIGS. 1 and 3, respectively. As a result, similarly numbered elements of button 410 may share any features described with respect to buttons 110 and 310, and vice versa.

Button 410 may include cosmetic portion 411, post 412, and cavity 414. Cosmetic portion 411 provides an outer surface for a user to press on. Cavity 414 may receive a protruding member of a seal assembly (e.g., protruding member 325 of FIG. 3) and align the seal assembly relative to button 410. Cavity 414 may include chamfer 417 along its periphery. Chamfer 417 may act as a lead-in for the protruding member of the seal assembly during assembly. Post 412 may include undercut 415 and tapered edge 416. Tapered edge 416 may guide and gently stretch a resilient portion of a seal assembly (e.g., post receiving hole 321 of FIG. 3) around post 412. Once the portion of the seal assembly is positioned around post 412, undercut 415 may help secure the seal assembly to button 410.

Figure 5A:
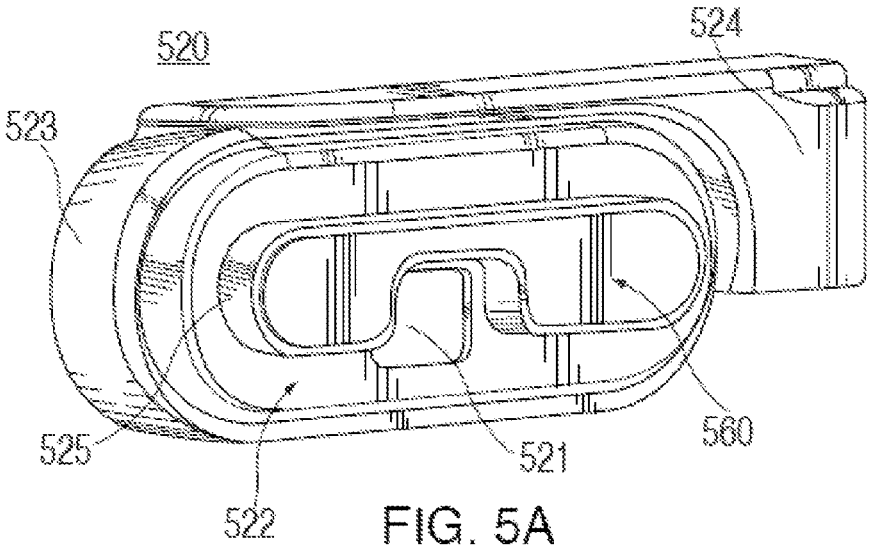
FIG. 5A shows a front perspective view of an illustrative sealing assembly including a co-molded part in accordance with an embodiment of the invention.
Figure 5B:
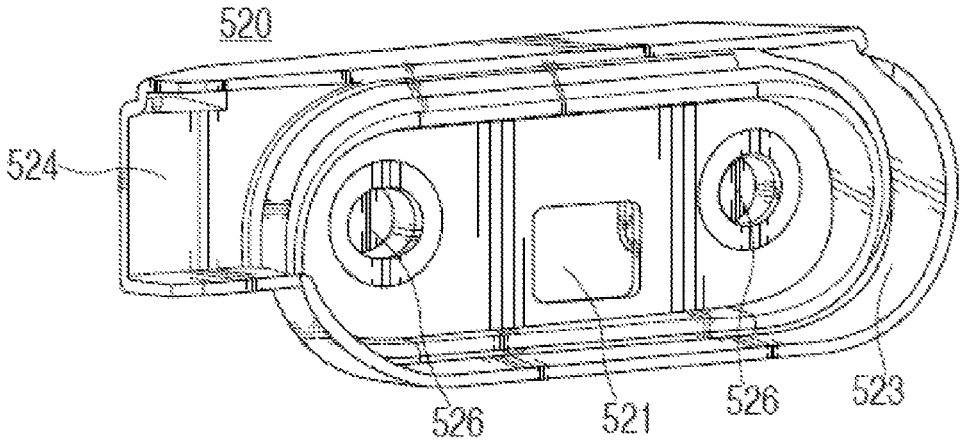
FIG. 5B shows a rear perspective view of the sealing assembly of FIG. 5A in accordance with an embodiment of the invention.
Figure 5C:
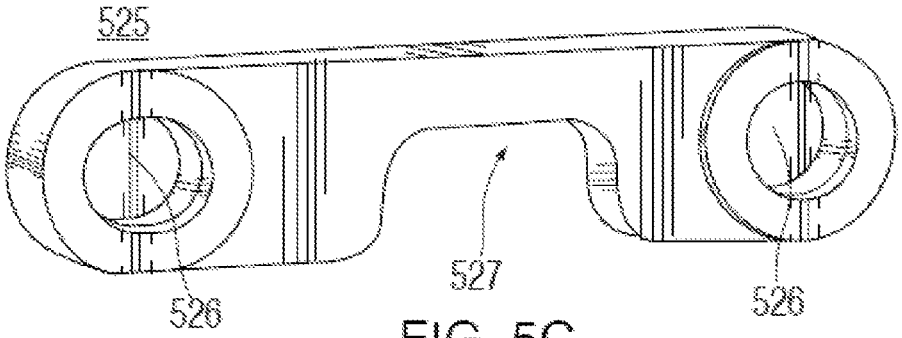
FIG. 5C shows a perspective view of the co-molded part of FIG. 5A in accordance with an embodiment of the invention.

Referring now to FIGS. 5A-5C, various views of an illustrative sealing assembly are shown in accordance with an embodiment of this invention. In particular, FIG. 5A shows a front perspective view of sealing assembly 520, FIG. 5B shows a rear perspective view of sealing assembly 520, and FIG. 5C shows a perspective view of co-molded protruding member 525. Sealing member 520 may be similar to seal assembly 320 shown in FIG. 3. As a result, similarly numbered elements of sealing assembly 520 may share any features described with respect to seal assembly 320, and vice versa.

Sealing assembly 520 may include post receiving hole 521, button engagement portion 522, device engagement portions 523 and 524, and protruding member 525. Protruding member 525 may be a co-molded part that provides enhanced stiffness with respect to the remainder of sealing assembly 520. For example, protruding member 525 may be molded from plastic or metal while the remainder of sealing assembly 520 may be molded from silicone. Protruding member 525 may extend from a front surface of sealing assembly 520 and may be shaped to occupy a cavity of a button (e.g., cavity 414 of FIG. 4). Adhesive 560 may be applied to a front surface of protruding member 525 to secure it the cavity of the button. Protruding member 525 may include registration holes 526 that align with another component of an electronic device and locate sealing assembly 520 relative to the other component. Protruding member 525 may also include cutout 527 to accommodate post receiving hole 521 and a post of a button (e.g., post 412 of FIG. 4). Cutout 527 may be shaped to fit around a portion of the post.

Figure 6A:
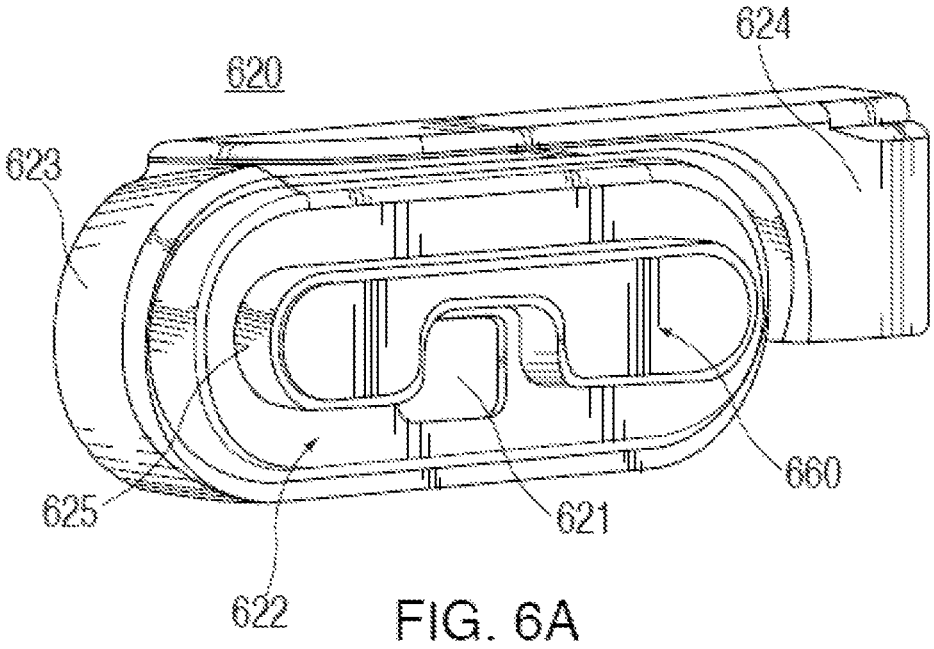
FIG. 6A shows a front perspective view of another illustrative sealing member in accordance with an embodiment of the invention.
Figure 6B:
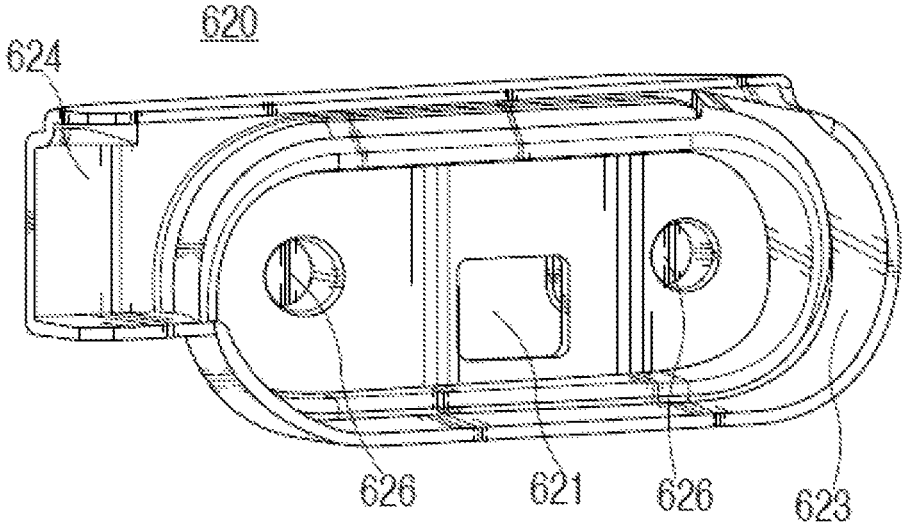
FIG. 6B shows a rear perspective view of the sealing member of FIG. 6A in accordance with an embodiment of the invention.

Referring now to FIGS. 6A and 6B, various views of another illustrative sealing member are shown in accordance with an embodiment of this invention. In particular, FIG. 6A shows a front perspective view of sealing member 620 and FIG. 6B shows a rear perspective view of sealing member 620. Sealing member 620 may be similar to seal assembly 320 shown in FIG. 3. As a result, similarly numbered elements of sealing assembly 620 may share any features described with respect to seal assembly 320, and vice versa.

Sealing member 620 may include post receiving hole 621, button engagement portion 622, device engagement portions 623 and 624, and protruding member 625. In this embodiment, protruding member 625 may be molded from the same material (e.g., silicone) as the remainder of sealing member 620. Constructing sealing member 620 from a single material may provide a significant cost savings. Protruding member 625 may extend from a front surface of sealing assembly 620 and may be shaped to occupy a cavity of a button (e.g., cavity 414 of FIG. 4). Adhesive 660 may be applied to a front surface of protruding member 625 to secure it the cavity of the button. Protruding member 625 may include registration holes 626 that align with another component of an electronic device and locate sealing assembly 620 relative to the other component. Registration holes 626 may be formed in protruding member 625 as part of the molding process.

Figure 7A:
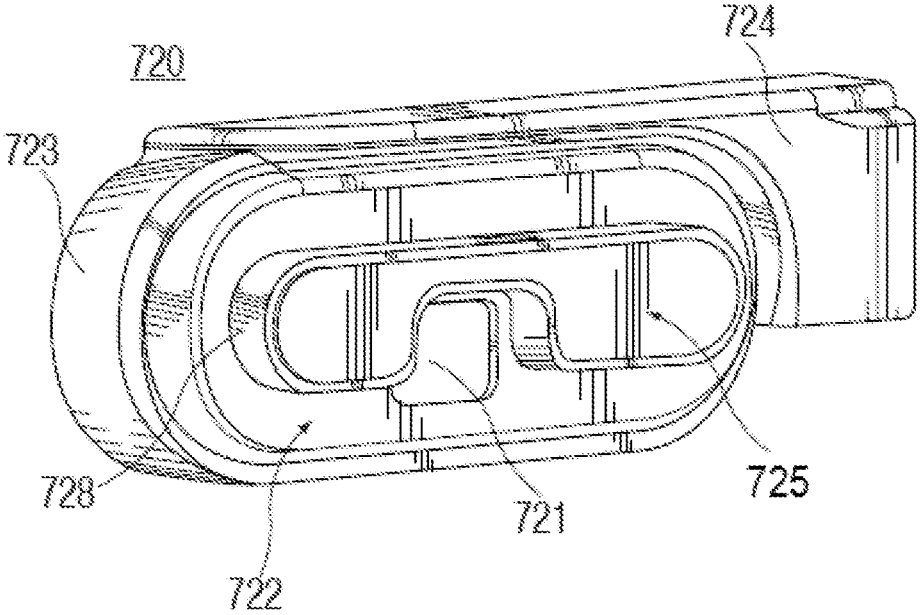
FIG. 7A shows a front perspective view of yet another illustrative sealing assembly in accordance with an embodiment of the invention.
Figure 7B:
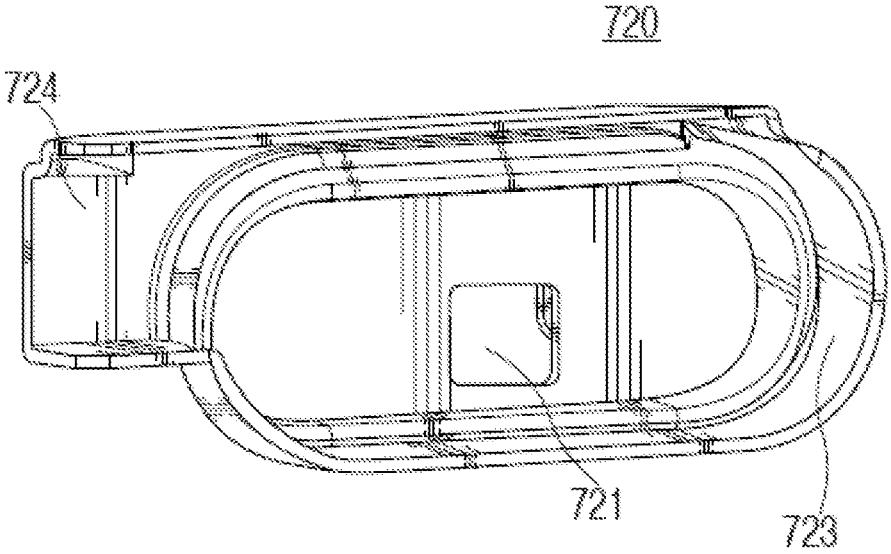
FIG. 7B shows a rear perspective view of the sealing assembly of FIG. 7A in accordance with an embodiment of the invention.

Referring now to FIGS. 7A and 7B, various views of yet another illustrative sealing assembly are shown in accordance with an embodiment of this invention. In particular, FIG. 7A shows a front perspective view of sealing assembly 720 and FIG. 7B shows a rear perspective view of sealing assembly 720. Sealing member 720 may be similar to seal assembly 320 shown in FIG. 3. As a result, similarly numbered elements of sealing assembly 720 may share any features described with respect to seal assembly 320, and vice versa.

Sealing assembly 720 may include post receiving hole 721, button engagement portion 722, device engagement portions 723 and 724, and protruding member 725. In some embodiments, protruding member 725 may include shim 728 located around its outer periphery. In these embodiments, protruding member 725 may be formed from the same material as the remainder of sealing assembly 720 (e.g., silicone) while shim 728 may be formed from a more rigid material such as metal or plastic. In some embodiments, shim 728 may be co-molded with the remainder of sealing assembly 720. In other embodiments, shim 728 may be attached to protruding member 725 using a glue or an adhesive.

Figure 8:
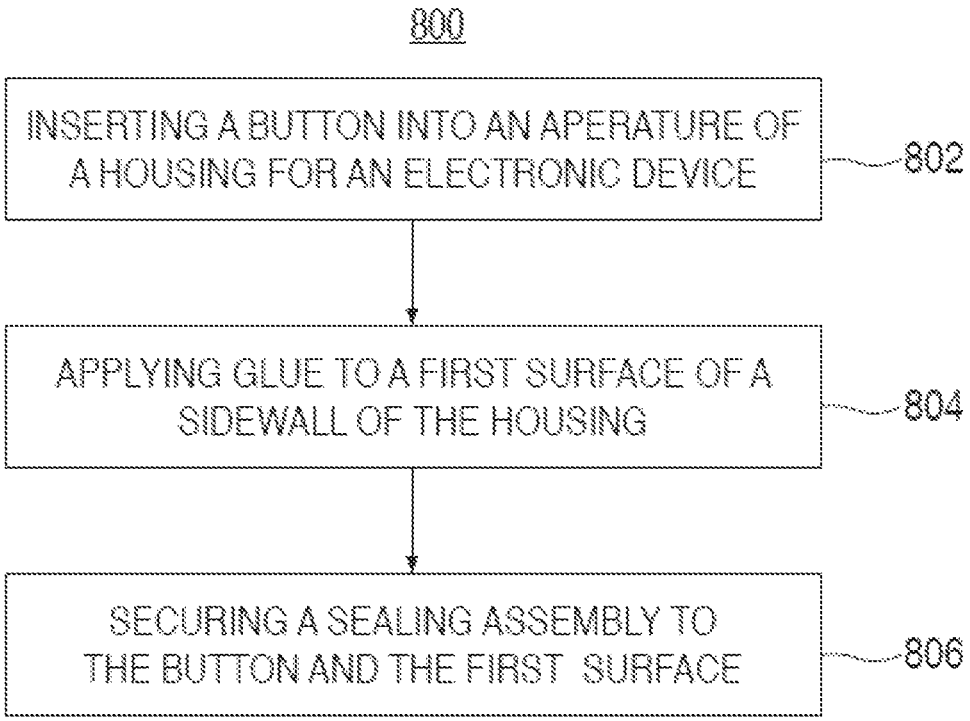
FIG. 8 shows an illustrative method for assembling a water proof button in an electronic device in accordance with some embodiments of the invention.

FIG. 8 shows an illustrative method for assembling a water proof button in an electronic device in accordance with some embodiments of the invention. Method 800 may begin at step 802. At step 802, a button (e.g., button 310 of FIG. 3) may be inserted into an aperture of a housing for an electronic device (e.g., aperture 331 of FIG. 3). The button may have features that help secure it within the aperture (e.g., flange portions 313 of FIG. 3). At step 804, glue may be applied to a first surface of a sidewall of the housing. The glue may be applied to the first surface at a location where a sealing assembly is expected to interface with the sidewall. For example, glue may be applied to a location where device engagement portion 323 or 324 is expected to interface with housing 330. In some embodiments, glue may instead be applied to the sealing assembly directly (e.g., glue may be applied to device engagement portion 323 and/or 324).

At step 806, a sealing assembly (e.g., seal assembly 320 of FIG. 3) may be secured to the button and the first surface. The sealing assembly may be secured to the button via glue and/or adhesive. For example, a protruding portion (e.g., protruding member 325 of FIG. 3) may be secured within a cavity of the button (e.g., cavity 314 of FIG. 3) using a pressure sensitive adhesive (e.g., via adhesive 360 of FIG. 360). Additionally, the sealing assembly may be secured to the button via an interference fit. For example, a post receiving hole of the sealing assembly (e.g., post receiving hole 321 of FIG. 3) may be positioned around a post of the button (e.g., post 312 of FIG. 3). The sealing assembly may be secured to the first surface via the glue applied in step 804. Method 800 may then conclude at step 806. Although the method for constructing a water proof button in an electronic device is presented using sequentially numbered steps, it is understood that the order of the steps may be altered without deviating from the scope of this disclosure.

As used herein, the term "electronic device" can include, but is not limited to, music players, video players, still image players, game players, other media players, music recorders, video recorders, cameras, other media recorders, radios, medical equipment, calculators, cellular telephones, other wireless communication devices, personal digital assistants, programmable remote controls, pagers, laptop computers, printers, or combinations thereof.

The previously described embodiments are presented for purposes of illustration and not of limitation. It is understood that one or more features of an embodiment can be combined with one or more features of another embodiment to provide systems and/or methods without deviating from the spirit and scope of the invention. It will also be understood that various directional and orientational terms are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Those skilled in the art will appreciate that the invention can be practiced by other than the described embodiments, which are presented for purposes of illustration rather than of limitation, and the invention is limited only by the claims which follow.

What is claimed is:

1. An electronic device, comprising:

a housing including housing walls that define a space within the housing, one of the housing walls having an aperture;

a button including a cosmetic portion that protrudes from a flange portion of the button, wherein the cosmetic portion extends through the aperture of the housing, the button including a cavity defined by an internal surface and a post extending from the internal surface; and a seal assembly comprising a first section and a second section, wherein:

the first section includes a protruding member and a post receiving hole, the protruding member occupying the cavity of the button such that a first surface of the first section is secured to the internal surface of the button, wherein the post extends through the post receiving hole, and the second section includes a second surface secured to the flange portion of the button such that the button constrains the seal assembly within the space of the housing, wherein the first surface is separated from the second surface by a gap.

2. The electronic device of claim 1, wherein the post comprises a beveled edge at a distal end of the post.

3. The electronic device of claim 1, wherein the post comprises an undercut operative to help retain the seal assembly.

4. The electronic device of claim 1, wherein the cosmetic portion forms an exterior surface of the electronic device.

5. The electronic device of claim 1, wherein the button further comprises a chamfered edge along a perimeter of the cavity.

6. The electronic device of claim 1, wherein a dimension of the post is larger than a corresponding dimension of the post receiving hole.

7. The electronic device of claim 1, wherein the protruding member comprises at least one registration hole.

8. The electronic device of claim 1, wherein the seal assembly is constructed from a compliant material.

9. The electronic device of claim 1, wherein the protruding member comprises a co-molded part operative to provide enhanced stiffness with respect to a remainder of the seal assembly.

10. The electronic device of claim 9, wherein the co-molded part is constructed from one of a metal and a plastic.

11. The electronic device of claim 9, wherein the co-molded part is a shim that forms a periphery of the protruding member.

12. The electronic device of claim 1, wherein the protruding member comprises a cutout around a portion of the post receiving hole.

13. The electronic device of claim 1, wherein the protruding member is fixed to the internal surface of the button within the cavity with glue or a pressure sensitive adhesive.

14. The electronic device of claim 1, wherein the seal assembly is secured to a sidewall surface of the housing with glue or a pressure sensitive adhesive.

15. A method for assembling a water proof button in an electronic device, the device comprising a housing with housing walls that define a space within the housing, one of the housing walls including an aperture, the method comprising:

inserting a cosmetic portion of a button into the aperture of the housing such that a flange portion of the button is positioned within the space of the housing, the button comprising a cavity defined by an internal surface and a post extending from the internal surface;

applying a first portion of glue to the internal surface of the button and a second portion of glue to a surface of the flange portion; and securing a sealing assembly to the button and the housing, the sealing assembly comprising a first section and a second section, wherein securing the sealing assembly comprises positioning a protruding member of the sealing assembly within the cavity of the button such that:

a first surface of the first section contacts the first portion of glue securing the first section to the button, wherein the post of the button extends through a post receiving hole of the first section, and a second surface of the second section contacts the second portion of glue securing the second section to the button, wherein the button constrains the sealing assembly within the space of the housing, wherein the first surface is separated from the second surface by a gap.

16. The method of claim 15, wherein the protruding member comprises at least one registration hole, and wherein the method further comprises aligning the at least one registration hole with a corresponding feature within the electronic device.

17. The method of claim 15, wherein the securing further comprises stretching the post receiving hole of the sealing assembly around the post to form a compression fit between the post receiving hole and the post.

18. The method of claim 15, further comprising aligning a switch with the post such that the switch is activated by the post when the button is actuated.

19. A water tight button assembly for use in an electronic device having a housing, the housing including housing walls that define a space within the housing with one of the walls including an aperture, the water tight button assembly comprising:

a button including a cosmetic portion that protrudes from a flange portion of the button, wherein the cosmetic portion is positioned within the aperture of the housing, the button including a cavity and a post, wherein the cavity is defined by an internal surface and the post extends from the internal surface; and a sealing member comprising a first section and a second section, wherein:

the first section includes a protruding member and a post receiving hole, the protruding member occupying the cavity of the button such that a first surface of the first section is secured to the internal surface of the button, wherein the post extends through the post receiving hole, and the second section includes a second surface secured to the flange portion of the button such that the button constrains the sealing member within the space of the housing, wherein the first surface is separated from the second surface by a gap.

20. The button assembly of claim 19, wherein the post comprises an undercut operative to help retain the sealing member.

21. The button assembly of claim 19, wherein a dimension of the post is larger than a corresponding dimension of the post receiving hole.

22. The button assembly of claim 19, wherein the sealing member comprises at least one registration hole.

23. The button assembly of claim 19, wherein the sealing member comprises a co-molded part operative to provide enhanced stiffness with respect to a remainder of the sealing member.

* * * * *